US008733135B2

(12) United States Patent
Bringewatt et al.

(10) Patent No.: US 8,733,135 B2
(45) **Date of Patent: *May 27, 2014**

(54) METHOD AND DEVICE FOR WET TREATING LAUNDRY ITEMS

(75) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 1472 days.

This patent is subject to a terminal disclaimer.

(21) Appl. No.: 11/815,646

(22) PCT Filed: Jan. 18, 2006

(86) PCT No.: PCT/EP2006/000384

§ 371 (c)(1),
(2), (4) Date: May 9, 2008

(87) PCT Pub. No.: WO2006/084548

PCT Pub. Date: Aug. 17, 2006

(65) Prior Publication Data

US 2011/0173761 A1 Jul. 21, 2011

(30) Foreign Application Priority Data

Feb. 11, 2005 (DE) ..... 10 2005 006 559
Aug. 12, 2005 (DE) ..... 10 2005 038 142
Nov. 4, 2005 (DE) ..... 10 2005 053 085

(51) Int. Cl.
*D06F 29/02* (2006.01)

(52) U.S. Cl.
USPC ..... 68/23.5; 68/27; 68/30; 68/58

(58) Field of Classification Search
USPC ..... 68/23.5, 27, 30, 58
See application file for complete search history.

(56) References Cited

U.S. PATENT DOCUMENTS 4,020,659 A * 5/1977 Bhavsar ..... 68/27
4,195,498 A * 4/1980 Pellerin ..... 68/3 R
4,546,511 A * 10/1985 Kaufmann ..... 8/158
4,879,887 A * 11/1989 Kagi et al. ..... 68/16
5,784,901 A * 7/1998 Yanase et al. ..... 68/27
8,075,636 B2 * 12/2011 Bringewatt ..... 8/137

FOREIGN PATENT DOCUMENTS

CN 2059922 U 5/1990
DE 30 40 449 A1 5/1982
DE 100 31 040 A1 2/2001
GB 2060001 * 4/1981

OTHER PUBLICATIONS

Chinese Office Action for No. 200680004588.1 dated May 8, 2009 issued in corresponding case.

* cited by examiner

*Primary Examiner* — Robert C Boyle
(74) *Attorney, Agent, or Firm* — Laurence P. Colton; Smith Risley Tempel Santos LLC

(57) ABSTRACT

An inline washing system to be formed from a tunnel-type washing machine (10) which both rinses and removes water from the items of laundry. However, rinsing and simultaneously also water removal can also be performed in the downstream spin-dryer (18) or water-removal press. It has been found that the rinsing performance is better and fresh water can be saved on account of the invention. By virtue of the invention, it is possible to wash relatively small amounts of laundry using a tunnel-type washing machine (10) in an economical manner. The tunnel-type washing machine (10) can be designed to be shorter and also simpler if it is designed without a rinse zone.

18 Claims, 5 Drawing Sheets

METHOD AND DEVICE FOR WET TREATING LAUNDRY ITEMS

BACKGROUND OF THE INVENTION

1. Technical Field

The invention relates to a method for the wet-treatment of items of laundry with the items of laundry being washed in a washing device and at least water being removed in at least one downstream water removal device, with the items of laundry being at least washed optionally rinsed in successive treatment zones, or with the items of laundry being at least washed in successive treatment zones and the items of laundry being rinsed after washing operation and to an apparatus for the wet-treatment of items of laundry, or for wet treatment of items of laundry in a tunnel-type washing machine.

2. Related Art

Liquids are used for the wet-treatment of laundry, in particular for washing and rinsing items of laundry, with said liquids substantially being fresh water in the case of rinsing. The rinse result is also dependent on the quantity of fresh water used. However, for environmental reasons, it is desirable to reduce the fresh-water requirement as far as possible.

So-called tunnel-type washing machines comprising an elongate drum which can be driven in rotation and in which successive chambers are formed have proven advantageous for washing and rinsing items of laundry. In known tunnel-type washing machines, at least three zones, namely a pre-wash zone, a main-wash zone and a rinse zone, are arranged in series. A counter-current of free liquor is required in the rinse zone, and for this reason additional outer chambers have to be associated with the drum. As a result, the known tunnel-type washing machines have a relatively complicated structure, and so tunnel-type washing machines are used only where large amounts of laundry are to be handled. On account of the at least three successive zones, the drum has to have a relatively long length, as a result of which the known tunnel-type washing machines take up a great deal of space in the laundry facility.

BRIEF SUMMARY OF THE INVENTION

The object of the invention is to provide a method and an apparatus for the wet-treatment of, preferably also small quantities of, items of laundry in an economical manner.

One method for achieving this object is a method for the wet-treatment of items of laundry, with the items of laundry being washed in a washing device and at least water being removed in at least one downstream water-removal device, comprising the steps of rinsing and removing water from the items of laundry in the or each water-removal device. Since the respective water-removal device not only removes water from the laundry but also rinses the laundry, the rinse process can be moved from the washing device to the water-removal device. As a result, the rinse zone can be omitted from the washing device, as a result of which the washing device can be of simpler construction, in particular takes up less space. Since the water-removal device does not need to be changed for the purpose of additional rinsing of the laundry, the method according to the invention provides a space-saving inline washing system overall. In addition, it has surprisingly been found that the laundry can be rinsed in the water-removal device far more effectively than in the washing device. In this way, the rinsing performance is improved and this leads to fresh water being saved.

Provision is also made for the laundry to be transferred from the washing device to the at least one water-removal device with only at least some of the bound liquor from the main-washing operation. As a result, the bound liquor or a large part of the bound liquor no longer needs to be separated from the laundry in the washing device. In contrast, the free liquor has to be separated from the laundry, with the result that the free liquor cannot be transferred with the laundry to the at least one water-removal device.

According to one preferred refinement of the method according to the invention, at least some of the bound liquor is preferably removed from the laundry in the water-removal device, before the laundry is rinsed in the water-removal device. The bound liquor can be separated from the laundry in the water-removal device in a very simple and above all more effective manner than in the washing device. As a result, more effective rinsing can be performed, and this not only shortens the rinse cycle but above all also contributes to a saving of fresh water because less fresh water is required for effective rinsing if at least a large part of the bound liquor has already been separated from the laundry. However, it is also feasible, as an alternative or in addition, to separate some of the bound liquor—and also the free liquor—from the laundry as early as in the washing device.

Provision is also made for the items of laundry to be transferred directly from the washing device to one or more water-removal devices. If the cycle time of the washing device corresponds approximately to that of the water-removal device, a single water-removal device is sufficient. In cases where, on account of the rinse phase which is also performed in the water-removal device according to the invention, the residence time of the items of laundry in the water-removal device is longer than in the washing device, provision is made to use a plurality of water-removal devices which are alternately loaded with items of laundry from the washing device.

As an alternative, it is also feasible to temporarily store the laundry before transferring it to the water-removal device. Different cycle times between the washing device and the water-removal device can be compensated as a result of this too, with it then possibly being sufficient for only one single water-removal device to be associated with the washing device, with the washed items of laundry being temporarily stored until the water-removal device is available in the event of staggered cycles between the washing device and the water-removal device. As a result, the washing device can be operated completely independently of the water-removal device. A plurality of temporary storage means can be provided if necessary.

According to one preferred refinement of the method, the water-removal device used is at least one spin-dryer. A spin-dryer of this type has a drum which can be driven in rotation in a circulating manner and which separates liquid from the items of laundry by virtue of high rotational spinning speeds in the manner of a centrifuge. In a spin-dryer of this type, rinsing can be carried out in a particularly advantageous manner without design changes compared to conventional spin-dryers being required for this purpose. It is only necessary to change the control system of known spin-dryers.

According to an alternative refinement of the invention, it is also possible for the water-removal device used to be at least one water-removal press. The water-removal press initially removes at least some of the bound liquor from the laundry. The laundry is then rewetted with fresh water. Rewetting is preferably performed with as much water as the laundry can absorb. In at least one further water-removal process, which therefore also serves as a rinse process, the fresh water is then pressed out of the laundry again. This process can be repeated a number of times, with fresh water always being used or the pressed-out water being captured and reused at least once at least for the first water-removal processes, which are actually rinse processes. Fresh water is then used again at least in the last water-removal process and a last rinse step is performed in this way during the last water-removal operation.

Furthermore, the method according to the invention makes provision for the washing device used to be a tunnel-type washing machine which serves only for washing but not for rinsing the laundry. The tunnel-type washing machine preferably has an elongate drum which can be driven in rotation and in which successive chambers are formed, with one or more chambers forming a prewash zone and a main-wash zone. Tunnel-type washing machines of this type have proven advantageous in practice. To date, they have been extremely long on account of possessing a plurality of successive zones. Since rinsing no longer takes place in the tunnel-type washing machine according to the invention, said tunnel-type washing machine does not require any additional rinse zones with outer chambers for generating a counter-current, as a result of which the tunnel-type washing machine is shorter and also has a simpler structure. A simplified tunnel-type washing machine of this kind with only one prewash zone and one main-wash zone can also be used in an economical manner for the wet-treatment of small batches of laundry.

In order to carry out the method according to the invention, a tunnel-type washing machine of this kind which washes the items of laundry in a rotating manner is preferably used. That is to say, the drum of the tunnel-type washing machine is continuously driven in a circulating manner during the wash process, with the result that it executes complete revolutions in succession, it being possible to occasionally change the direction of rotation during the wash process in order to reverse the wash process.

An apparatus for achieving the object mentioned in the introduction is an apparatus for the wet-treatment of items of laundry, comprising a tunnel-type washing machine and at least one water-removal device, wherein the tunnel-type washing machine has only a prewash zone and a main-wash zone. Accordingly, provision is made for the apparatus to have a tunnel-type washing machine which is provided only with a prewash zone and a main-wash zone. Accordingly, the rinse zone which is customary in known tunnel-type washing machines is omitted. As a result, the tunnel-type washing machine of the apparatus can be of simpler structure. In particular, the tunnel-type washing machine is shortened on account of the rinse zone being omitted and therefore takes up only a relatively small amount of space.

The tunnel-type washing machine preferably has a drum which can be driven in rotation and in which successive chambers are formed. At least one chamber serves to form the prewash zone, while at least one other chamber is provided for the main-wash zone. Furthermore, the drum can be driven in rotation in a circulating manner. As a result, the laundry in the drum is washed in a rotating manner on account of successive complete revolutions of the drum. The drum can be reversed after a specific number of complete revolutions, with the result that washing is performed with complete revolutions of that drum in opposite directions. As an alternative, but also at least sometimes, the drum can execute partial circular movements in opposite directions, that is to say can be driven "so as to pivot".

Provision is also made for the or each water-removal device to be in the form of a spin-dryer. As a result, it is possible to rinse and to remove water from the laundry using conventional water-removal devices without changing the structure of said water-removal devices.

In a preferred apparatus, the respective spin-dryer is a high-power spin-dryer in which the laundry can be subjected to centrifugal acceleration of 600 times the acceleration due to gravity or above at least during spin-drying. On account of this, water is removed from the laundry quickly and effectively, as a result of which the residence time of the laundry in the spin-dryer corresponds virtually to the passage time of the laundry through the tunnel-type washing machine in spite of the additional rinse process, or at any rate is not significantly greater. In this way, the cycle times of the tunnel-type washing machine on the one hand and of the spin-dryer on the other are approximately equal, or at least do not considerably differ from one another.

In one alternative refinement of the apparatus, it is feasible to arrange a plurality of spin-dryers or else water-removal presses downstream of a single tunnel-type washing machine. It is then possible for the cycle time in the tunnel-type washing machine to be shorter than in the respective spin-dryer since one of the plurality of water-removal devices alternately receives the batch of laundry from the tunnel-type washing machine and final treatment of the items of laundry is performed in cycles in an overlapping manner in the water-removal devices in the event of offset treatment cycles of the items of laundry in the water-removal devices.

In another alternative refinement of the apparatus, provision is made for at least one laundry-storage means to be arranged between the tunnel-type washing machine and at least one of these downstream spin-dryers or water-removal presses. A single water-removal device may then be sufficient if the cycle time for treating the laundry in the spin-dryer or water-removal press is somewhat greater than in the tunnel-type washing machine since the laundry, which cannot be immediately finally treated, is initially buffer-stored in at least one laundry-storage means until the water-removal device is available. As a result, operation of the tunnel-type washing machine can be decoupled from the water-removal device.

A further method for achieving the object mentioned in the introduction is a method for the wet-treatment of items of laundry, with the items of laundry being at least washed and rinsed in successive treatment zones, comprising the steps of removing water is removed from and rinsing the items of laundry in a common treatment zone. On account of the fact that rinsing and water-removal are carried out in a common treatment zone, the water-removal device is integrated in the tunnel-type washing machine. A separate water-removal device downstream of the tunnel-type washing machine can therefore be dispensed with. Therefore, the following procedure is preferably followed: in the last treatment zone, the laundry is initially at least partially freed not only from the free liquor but also from the bound liquor. Rinsing is then performed with fresh water, with the rinse water, to be precise also the bound liquor, being removed from the laundry at the end of the rinse process. The water-removal system in the last treatment zone of the tunnel-type washing machine preferably operates in accordance with the spin-dry principle. However, it is also feasible for the liquor from the main-washing operation which is still bound in the items of laundry to be continuously removed from the laundry with the addition of fresh water, with the supply of fresh water being stopped at the end of the rinse process and the laundry being spun-dry without the addition of any more water, with said laundry being at least partially freed from the bound liquor.

A further apparatus for achieving the object mentioned in the introduction is an apparatus for the wet-treatment of items of laundry in a tunnel-type washing machine, wherein the tunnel-type washing machine has a prewash zone, a main-wash zone and a final-treatment zone for combined water removal from and rinsing of or rinsing of and water removal from the items of laundry. This apparatus comprises substantially only the tunnel-type washing machine. At least a prewash zone, a main-wash zone and a final-treatment zone are provided in the tunnel-type washing machine. The final-treatment zone serves the purpose of combined rinsing of and water removal from or water removal from and rinsing of the laundry. In this way, the water-removal device is integrated in the rinse zone, as a result of which a separate water-removal device can be dispensed with.

According to one preferred refinement of the apparatus, the prewash zone and the main-wash zone are arranged in a common drum of the tunnel-type washing machine, which drum can be driven in rotation in a circulating manner or so as to pivot. In contrast, the final-treatment zone for rinsing and water removal can be arranged in a separate drum of the tunnel-type washing machine which follows the drum for forming the prewash zone and the main-wash zone. In one preferred refinement of the invention, the two drums follow one another on the same axis. Separation of the drums for the prewash zone and the main-wash zone on the one hand and the final-treatment zone on the other leads to it being possible to drive the drum in the final-treatment zone at least for water-removal purposes, optionally also for rinsing the laundry, in a different way than in the prewash zone and the main-wash zone, in particular at a higher rotational speed which is required in order to effectively remove water from the laundry, that is to say to separate a large amount of the bound liquor from the laundry.

The object mentioned in the introduction is further achieved by a method for the wet-treatment of items of laundry, with the items of laundry being at least washed in successive treatment zones and the items of laundry being rinsed after a washing operation, wherein the items of laundry are separated from at least some bound liquor before the rinsing operation. This method may also be a preferred development of the other methods which serve to achieve the object on which the invention is based. According to this, provision is made for the items of laundry to be separated at least from some of the bound liquor before rinsing. As a result, rinsing can be carried out more effectively because impurities in the bound liquor do not have to be removed during rinsing. The separation of at least some of the bound liquor from the items of laundry, which separation occurs before rinsing, not only simplifies the rinse process but also saves fresh water.

Provision is also made for at least some of the bound liquor from the preceding treatment, in particular the main-washing operation, to be separated from the items of laundry either in the last treatment zone of the tunnel-type washing machine, which treatment zone serves for rinsing and water-removal purposes, or in at least one separate water-removal device. However, it is also feasible for the bound liquor to be at least partially removed from the items of laundry while still in the tunnel-type washing machine, before the items of laundry, together with the rest of the bound liquor from the tunnel-type washing machine, are transferred to the at least one water-removal device, for example a spin-dryer or a water-removal press.

BRIEF DESCRIPTION OF THE DRAWINGS

Preferred exemplary embodiments of the invention are explained in greater detail below with reference to the drawing, in which.

DETAILED DESCRIPTION OF PREFERRED EMBODIMENTS

Figure 1:
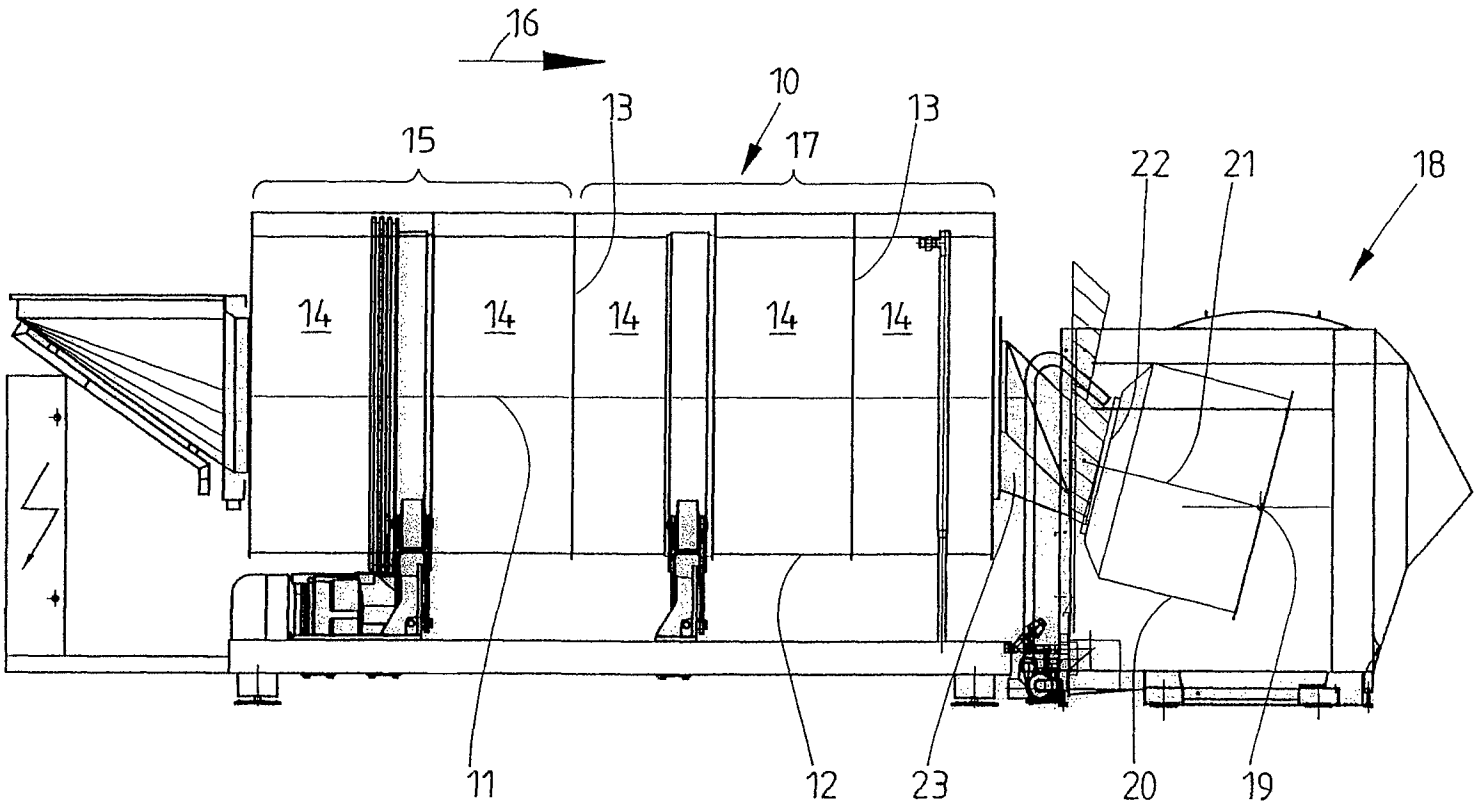
FIG. 1 shows a side view of the apparatus comprising a tunnel-type washing machine and a spin-dryer.

The apparatuses shown here each represent an inline washing system for the wet-treatment of items of laundry, in particular for washing, rinsing and removing water from said items of laundry. The apparatuses have a simplified tunnel-type washing machine 10, as a result of which said apparatuses are, in contrast to conventional tunnel-type washing machines, also suitable for washing relatively small amounts of laundry starting from 150 kg/h.

The tunnel-type washing machine 10 has a drum 12 which can be driven in rotation about a preferably horizontal axis of rotation 11. A plurality of chambers 14 which follow one another in the passage direction 16 of the items of laundry (not shown) through the drum 12 are formed in the drum 12 by transversely directed partition walls 13.

The drum 12 of the tunnel-type washing machine 10 contains essentially only two treatment zones, specifically a prewash zone 15 and a main-wash zone 17 which follows the prewash zone 15 in the passage direction 16 of the items of laundry through the drum 12. In the exemplary embodiment shown, five chambers 14 which follow one another in the passage direction 16 are formed in the drum 12 of the tunnel-type washing machine 10. In this case, two chambers 14 serve to form the prewash zone 15, while three chambers 14 form the main-wash zone 17. However, the invention is not restricted to tunnel-type washing machines 10 with five successive chambers 14. Instead, the number of chambers 14 may differ from the exemplary embodiment shown. It may be sufficient for the tunnel-type washing machine 10 to have only one single chamber 14 for forming the prewash zone 15 and one single chamber 14 for forming the main-wash zone 17. However, the number of chambers 14 in the main-wash zone 17 is generally higher than the number of chambers 14 in the prewash zone 15 by one chamber 14.

In the apparatus shown in FIG. 1, a single water-removal device is arranged downstream of the tunnel-type washing machine 10, said water-removal device preferably being a spin-dryer 18. The spin-dryer 18 has an outer drum 20 which can be pivoted about a horizontal pivot axis 19, but is otherwise stationary, and an inner drum (not shown) which is mounted in the outer drum 20 such that it can rotate about an axis of rotation 21 which runs transverse to the pivot axis 19. At one end, the outer drum 20 and also the inner drum have an opening 22 which is used to load the spin-dryer 18 with items of laundry and to unload items of laundry from said spin-dryer. The spin-dryer 18 is preferably designed as described in DE 103 43 306 A1. Reference is made to this document in its entirety. However, the invention can, in principle, also be implemented using other spin-dryers.

The spin-dryer 18 is arranged directly downstream of the tunnel-type washing machine 10, to be precise such that the fully washed items of laundry without the free liquor can be passed from a discharging chute 23 at that end of the drum 12 of the tunnel-type washing machine 10 which is at the rear in the passage direction 16 to the spin-dryer 18 directly through the opening 22.

Figure 2:
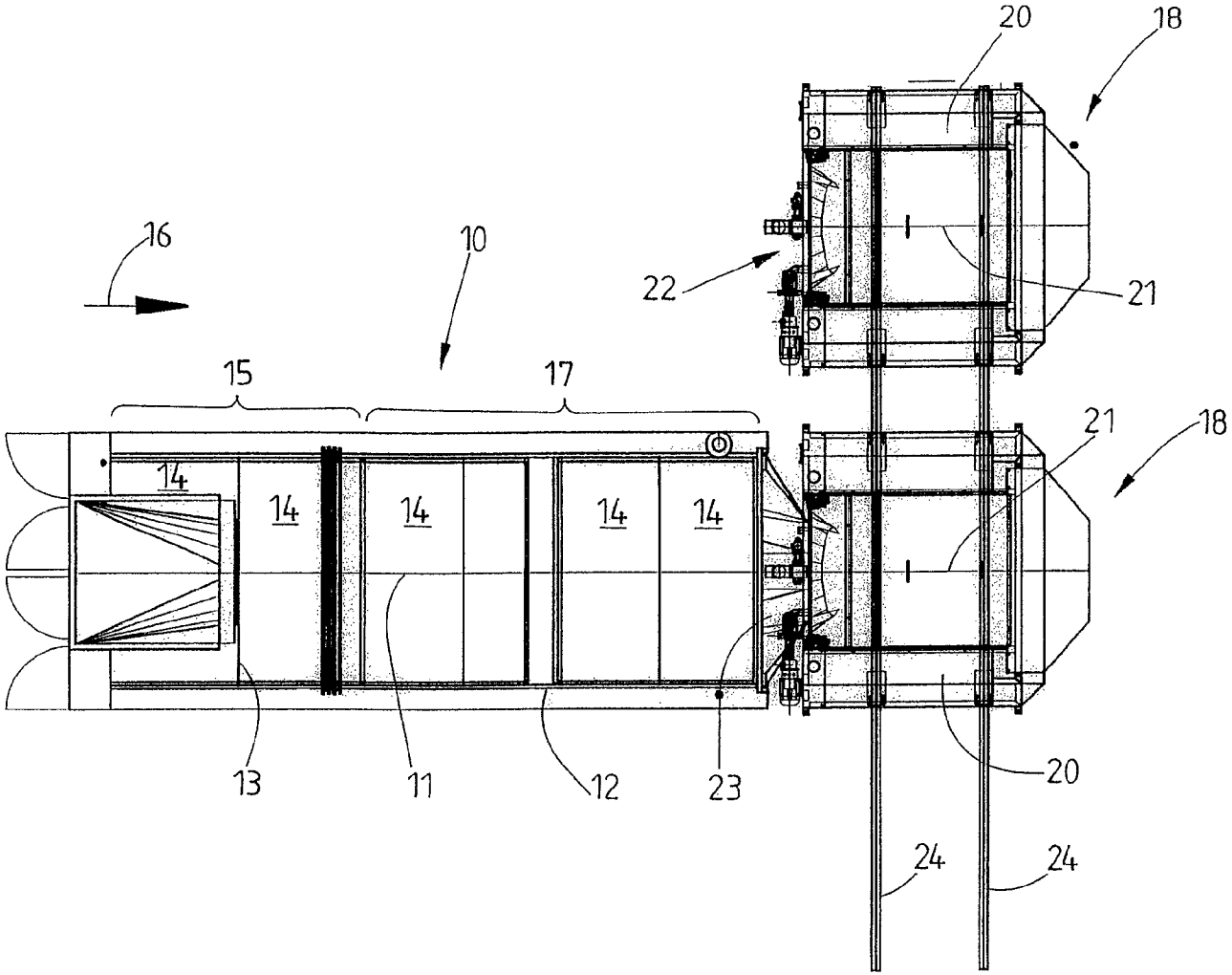
FIG. 2 shows a plan view of the apparatus comprising a tunnel-type washing machine and a plurality of spin-dryers according to a second exemplary embodiment of the invention.

FIG. 2 shows a second exemplary embodiment of the apparatus. Said apparatus has a tunnel-type washing machine 10 which, in principle, can be designed in the way described in conjunction with the exemplary embodiment from FIG. 1. Reference is made to said figure in order to avoid repetition.

In the exemplary embodiment shown here, a plurality of water-removal devices, to be precise specifically two preferably identical water-removal devices, are arranged at the outlet end of the tunnel-type washing machine 10, specifically behind the discharging chute 23. However, it is also possible to arrange more than two water-removal devices downstream of the tunnel-type washing machine 10.

The two water-removal devices are spin-dryers 18 in this case. The identical spin-dryers 18 are designed in the same way as the spin-dryer 18 which is described in conjunction with the exemplary embodiment from FIG. 1. The two spin-dryers 18 shown in FIG. 2 are arranged at a small distance next to one another such that the axes of rotation 21 of their inner drums run parallel to one another, to be precise in the direction of the axis of rotation 11 of the drum 12 of the tunnel-type washing machine 10. In this case, the openings 22 in the outer drums 20 and in the inner drums point toward the end of the discharging chute 23 at the output end of the tunnel-type washing machine 10. The two spin-dryers 18 can be moved on a track which runs transverse to the axis of rotation 11 of the drum 12 of the tunnel-type washing machine 10, to be precise either independently of one another or together. In the exemplary embodiment shown, this track is formed from parallel rails 24 on which the spin-dryers 18 can be moved transverse to the passage direction 16 of the tunnel-type washing machine 10. This is done in such a way that a spin-dryer 18 is alternately associated with the discharging chute 23 at the end of the tunnel-type washing machine 10 and therefore can be directly loaded with items of laundry arriving from the tunnel-type washing machine 10 by the discharging chute 23. The respective spin-dryer 18 is preferably unloaded following movement of said spin-dryer on the rails 24 next to the discharging chute 23 of the tunnel-type washing machine 10, for example in the position of the spin-dryer 18 in which it is not in line with the discharging chute 23 in FIG. 2.

Figure 3:
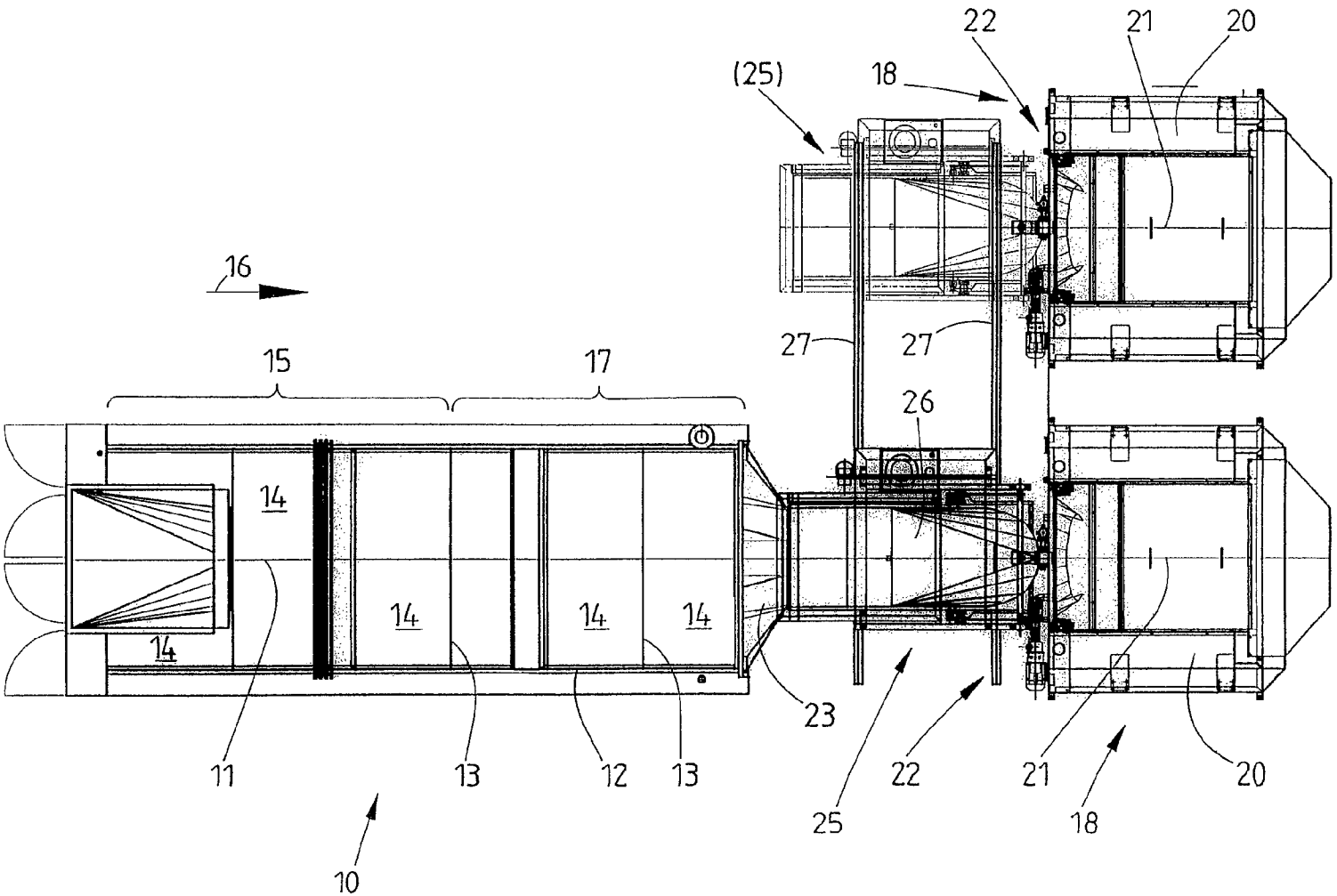
FIG. 3 shows a plan view of the apparatus comprising a tunnel-type washing machine, a plurality of spin-dryers and a laundry-storage means which is arranged therebetween according to a third exemplary embodiment of the invention.

FIG. 3 shows a third exemplary embodiment of the apparatus. This apparatus again has a single tunnel-type washing machine 10 which is designed in the same way as the tunnel-type washing machine 10 from FIG. 1. Reference is made to the description of the tunnel-type washing machine 10 in conjunction with FIG. 1.

In this case, two spin-dryers 18 are again arranged at a distance from and downstream of the discharging chute 23 of the tunnel-type washing machine 10. Said spin-dryers may be designed in the same way as the spin-dryer 18 which is described in greater detail in conjunction with FIG. 1. However, instead of one of the two spin-dryers 18, a different water-removal device may be arranged downstream of the tunnel-type washing machine 10 of the apparatus from FIG. 3.

In the apparatus from FIG. 3, a laundry-storage means 25 is located between the tunnel-type washing machine 10 and the spin-dryer 18. However, as an alternative, it is also feasible to provide a plurality of laundry-storage means between the tunnel-type washing machine 10 and the spin-dryers 18.

The laundry-storage means 25 preferably has a tiltable container 26 which is designed to accommodate at least one batch of laundry which is washed in a wash process in the tunnel-type washing machine 10. The container 26 is arranged downstream of the tunnel-type washing machine 10 in such a way that the items of laundry of at least one batch of laundry which leave said tunnel-type washing machine can pass directly into the container 26 of the laundry-storage means 25 via the discharging chute 23 at the rear end of the tunnel-type washing machine 10. From the container 26 of the laundry-storage means 25, the items of laundry can be tipped into a spin-dryer 18 through the opening 22.

The laundry-storage means 25 or its container 26 can be moved along a track which runs transverse to the axis of rotation 11 of the drum of the tunnel-type washing machine 10. The track can be formed from two parallel rails 27. However, the container 26 of the laundry-storage means 25 can also be moved in a different way, for example on wheels. In this case, the rails 27 can guide the wheels of the container 26 during movement. However, it is also feasible to move the laundry-storage means 25 on wheels in an unguided manner.

The method according to the invention is described in greater detail below with reference to the different apparatuses from FIGS. 1 to 3:

The items of laundry are subjected to only prewashing and main washing in the tunnel-type washing machine 10 in the case of the apparatus from FIG. 1. In the process, the items of laundry are transported through the prewash zone 15 and the main-wash zone 17 of the tunnel-type washing machine 10 in the passage direction 16. Each batch of laundry is initially prewashed in the prewash zone 15 and then subjected to main washing in the main-wash zone 17.

During prewashing and during main washing of the items of laundry, the tunnel-type washing machine 10 is preferably driven in rotation in a circulating manner, specifically rotationally. The drum 12 therefore executes successive complete revolutions about the axis of rotation 11 during the washing process. If desired, the direction of rotation of the drum 12 of the tunnel-type washing machine 10 can be changed once or more than once during the prewashing operation and also during the main-washing operation by the drum 12 being rotated in a circulating manner in phases with different directions of rotation, but with the drum 12 preferably executing a plurality of complete circuits in each direction, that is to say the drum 12 for washing the laundry in the tunnel-type washing machine 10 being driven in rotation both in one direction and in the other direction. However, the invention is also suitable for other types of drive of the drum, that is to say is not restricted to the above-described, preferred types of drive.

After the respective batch of laundry has then been washed in the main-wash zone 17, it leaves the tunnel-type washing machine 10 only with the bound liquor, that is to say without the free liquor. The respective batch of laundry with the bound liquor is transferred to the downstream spin-dryer 18, that is to say the spin-dryer is loaded with the washed laundry, including the washing liquid which is still at least largely bound therein (bound liquor), via the discharging chute 23.

The items of laundry are first rinsed in the spin-dryer 18. The items of laundry are only then spun-dry in the spin-dryer 18, specifically freed from at least a large part of the liquid adhering to the items of laundry and still bound therein.

At least some of the bound liquor is preferably removed from the items of laundry by a preliminary spin-drying operation before the items of laundry are rinsed in the water-removal device, in particular in the spin-dryer 18. The items of laundry can then be rinsed without the bound liquor from the wash process or only with some of the bound liquor from the tunnel-type washing machine 10.

The laundry is spun-dry in the spin-dryer 18—as is known from DE 103 43 306 A1—at a high rotational speed of, for example, 1000 rpm or above, with the result that the laundry is subjected to centrifugal acceleration which is greater than 600 times the acceleration due to gravity in the inner drum of the spin-dryer 18. If preliminary spin-drying is performed before rinsing in order to remove at least a large part of the bound liquor in the items of laundry arriving from the tunnel-type washing machine 10, this is preferably done at a rotational speed of the inner drum of less than 1000 rpm. When rinsing the items of laundry in the spin-dryer 18, the inner drum is driven at a relatively low rotational speed which is less than 500 rpm, preferably only less than 200 rpm.

The apparatus from FIG. 2 operates, in principle, in precisely the same way as the above-described apparatus. The only difference is that the washed batch of laundry leaving the tunnel-type washing machine 10 in each case with the bound liquor is optionally conveyed to one of the two spin-dryers 18 which are arranged downstream of the tunnel-type washing machine 10. Therefore, one of the two spin-dryers 18 is alternately loaded with a respective batch of laundry and rinsing and spin-drying is performed.

The spin-dryers 18 are moved on rails 24 transverse to the axis of rotation 14 of the drum 12 of the tunnel-type washing machine 10 in such a way that the respectively empty spin-dryer 18 is located behind the tunnel-type washing machine 10, with the result that the batch of laundry leaving said tunnel-type washing machine 10 can be passed to the respective spin-dryer 18 via the discharging chute 23. During loading of one spin-dryer 18, rinsing and spin-drying processes can be continued in the other spin-dryer 18. In this way, the spin-dryers 18 operate independently of one another. It is also possible to rinse and spin-dry two batches of laundry in a manner in which said processes are decoupled from one another.

After the rinsing and spin-drying processes in a spin-dryer 18 are complete, said spin-dryer is preferably unloaded in a position in which it is next to the tunnel-type washing machine 10. A particularly space-saving inline washing system can be formed as a result.

The method using the apparatus according to FIG. 2 is particularly suitable for wash processes in which the cycle time of the tunnel-type washing machine 10 is shorter than the cycle time in the spin-dryer 18. In this case, it is no longer necessary to wait until the preceding batch of laundry has been rinsed and spun-dry in the spin-dryer 18 to charge a spin-dryer 18 with washed laundry since it is possible to alternately charge one of the two spin-dryers 18. In addition, this method makes it possible to unload items of laundry, which have been rinsed and had water removed from them by spin-drying, at a different location to that where the spin-dryer 18 is loaded. In this method, it is also feasible to use different water-removal devices, for example a spin-dryer 18 and a laundry press, for different types of laundry. In this case, a spin-dryer 18 and another water-removal device, for example a water-removal press, are associated with the tunnel-type machine 10 in a manner which differs from the illustration in FIG. 2. It is also feasible to use spin-dryers 18 with different treatment modes, in particular different spinning intensities and different spinning speeds.

In the apparatus from FIG. 3, the items of laundry in the tunnel-type washing machine 10 are also prewashed and subjected to main washing in a drum 12 which is driven in a circulating manner, to be precise in the same way as is the case in the apparatuses of FIGS. 1 and 2.

Two spin-dryers 18 are again arranged downstream of the tunnel-type washing machine 10. However, the spin-dryers do not immediately follow the tunnel-type washing machine 10. Instead, a laundry-storage means 25 is arranged between the tunnel-type washing machine 10 and the spin-dryers 18. The laundry-storage means 25 can be moved transverse to the axis of rotation 11 of the drum 12 of the tunnel-type washing machine 10, with the result that a container 26 of the laundry-storage means 25 is always located in the vicinity of the discharging chute 23 of the tunnel-type washing machine 10. The respective batch of laundry is unloaded from the tunnel-type washing machine 10 directly into a container 26 of the laundry-storage means 25 via the discharging chute 23. From the container 26 of the laundry-storage means 25, the batch of laundry is loaded into the respectively free spin-dryer 18. In this way, unloading of the tunnel-type washing machine 10 and loading of the spin-dryers 18 can be decoupled. As a result, different cycle times for the treatment of the items of laundry in the tunnel-type washing machine 10 and the spin-dryer 18 can be compensated.

It is also feasible to design the container 26 of the laundry-storage means 25 to be large enough to simultaneously accommodate a plurality of batches of laundry. This is useful when the capacity of the respective spin-dryer 18 is greater than that of the tunnel-type washing machine 10. In this case, two batches of laundry from two wash processes in the tunnel-type washing machine 10 can be temporarily stored in the container 26 of the laundry-storage means 25 and passed together from the container 26 of the laundry-storage means 25 to a spin-dryer 18 at a given time. In this case, a single spin-dryer 18 may suffice.

In the exemplary embodiment shown, a single laundry-storage means 25 is present, with the laundry-storage means 25 having one container 26. However, it is also feasible to provide a single laundry-storage means 25 with two or more containers 26. One or other container 26 can optionally be loaded with items of laundry via the discharging chute 23 by moving the container 26 transverse to the axis of rotation 11 of the drum 12 in relation to the tunnel-type washing machine 10. If required, the items of laundry may be loaded from one or other container 26 into the spin-dryer 18 from the respective container 26 at a given time.

Figure 4:
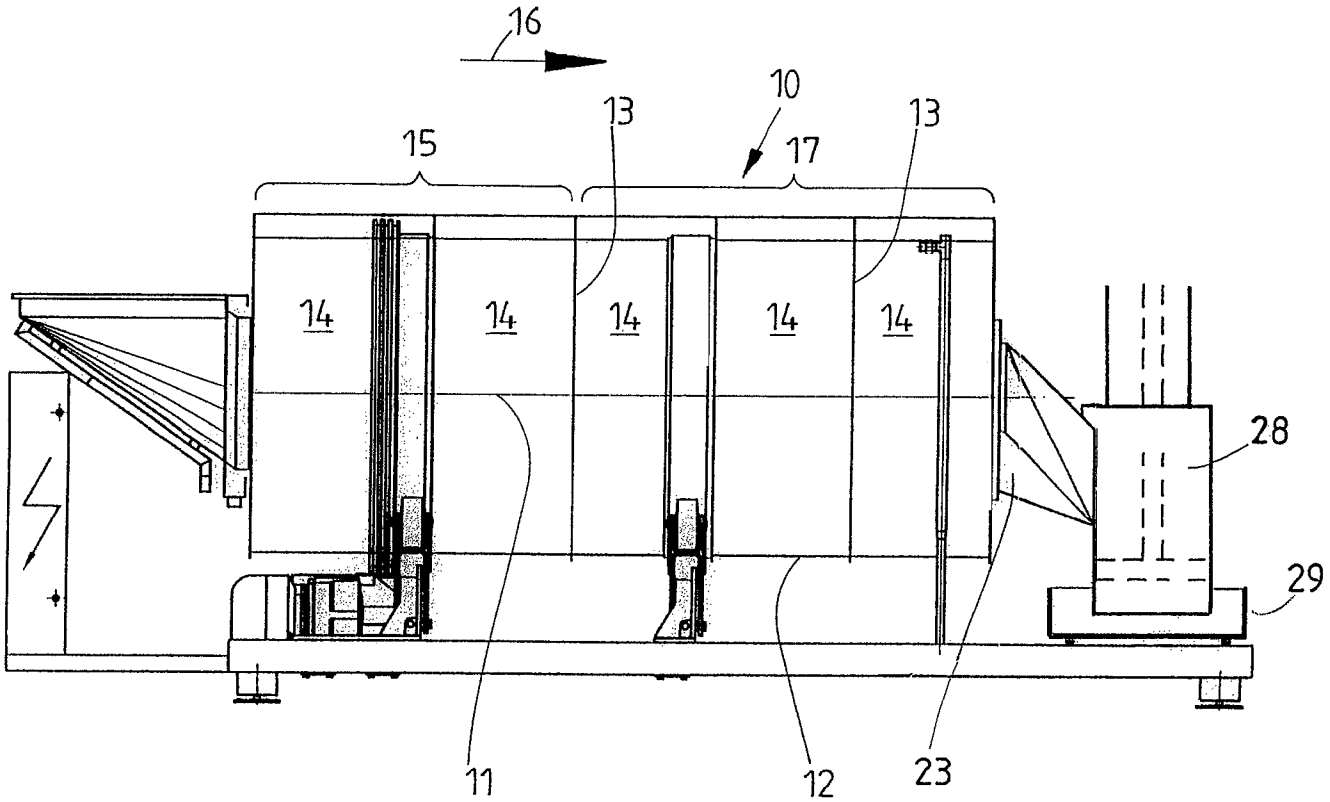
FIG. 4 shows a side view of an apparatus according to a fourth exemplary embodiment of the invention comprising a tunnel-type washing machine and a water-removal press.

FIG. 4 shows a fourth exemplary embodiment of the invention, with another water-removal device, to be precise a water-removal press 28, being arranged downstream of the tunnel-type washing machine 10. The tunnel-type washing machine 10 corresponds to that from FIGS. 1 to 3, for which reason identical reference numerals are used for the same parts in FIG. 4.

Like the spin-dryer 18 of the above-described exemplary embodiments, the water-removal press 28 also serves to rinse the items of laundry washed in the tunnel-type washing machine 10. Rinsing is performed with the water-removal press 28 in such a way that a plurality of pressing processes follow one another, with the items of laundry again being supplied with liquid, to be precise preferably an amount of liquid which corresponds at least to the bound liquor, before each individual pressing process, which at the same time constitutes a rinse process. Fresh water is preferably supplied at least in one pressing process. It is also feasible to carry out a few pressing processes with the same liquid since the pressed-out fresh water is collected in a collection tank 29 which is associated with the water-removal press 28 and reused for wetting the items of laundry. Pressing-out the liquid, in particular the fresh water, further serves to rinse the items of laundry in each case.

In general, the following procedure is followed: the items of laundry which are supplied to the water-removal press 28 from the tunnel-type washing machine 10 via the discharging chute 23 without the free liquor are initially at least partly, preferably largely, freed from their bound liquor in the water-removal press 28. At the beginning of the next pressing-out process, fresh water is then supplied to the items of laundry in an amount which can be absorbed by the items of laundry as bound liquor. However, it is also possible to supply more fresh water. The items of laundry are rinsed for the first time when this fresh water is pressed out. The pressed-out rinse water can be captured in the collection tank 29 and used for further water-removal processes which serve for rinsing purposes. It is also feasible to supply new fresh water to the items of laundry in each pressing-out process. However, new fresh water is used at least in the last rinsing and water-removal process.

A rinse zone is superfluous in the tunnel-type washing machine 10 in the above-described methods too. The tunnel-type washing machine 10 therefore also has only a prewash zone 15 and a main-wash zone 17 in this case. The rinse zone, which is omitted in the tunnel-type washing machine 10, is moved to the water-removal press 28.

In accordance with the principle of the above-described exemplary embodiments from FIGS. 2 and 3, it is also possible to arrange a plurality of water-removal presses 28, which are alternately operated, downstream of the tunnel-type washing machine 10 or to temporarily store the items of laundry leaving the tunnel-type washing machine 10, with the result that said items of laundry are not transferred directly to the water-removal press 28.

Figure 5:
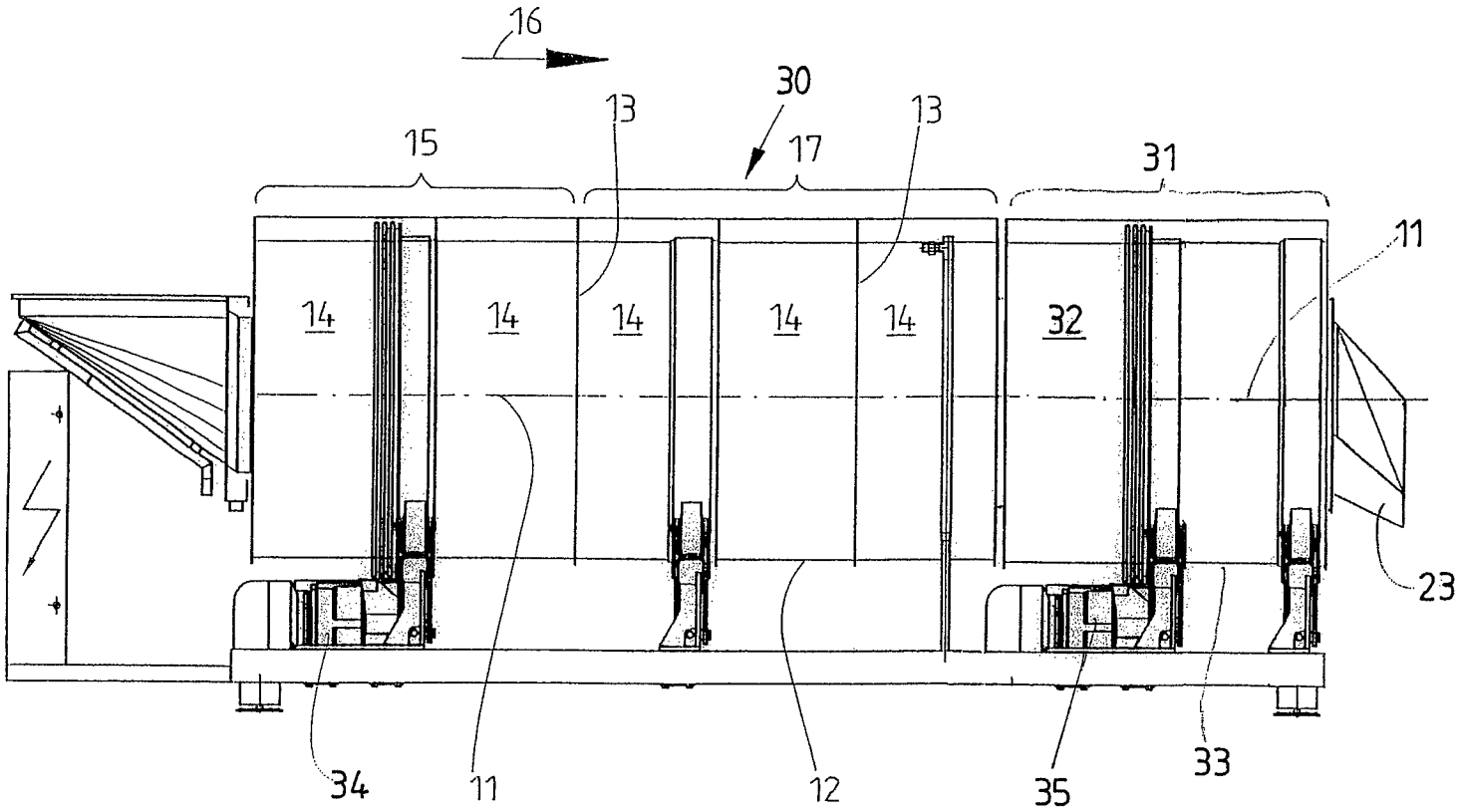
FIG. 5 shows a side view of an apparatus, specifically a tunnel-type washing machine, according to a fifth exemplary embodiment of the invention.

Finally, FIG. 5 shows a fifth exemplary embodiment of the invention, in which the water-removal device is integrated in the tunnel-type washing machine 30. As a result, the tunnel-type washing machine 30 has, in contrast to the tunnel-type washing machine 10 of the exemplary embodiments according to FIGS. 1 to 4, a further treatment zone. The tunnel-type washing machine 30 shown has a prewash zone 15, a main-wash zone 17 which follows said prewash zone in the passage direction 16, and a final-treatment zone 31 which is arranged downstream of the main-wash zone 17. In terms of the prewash zone 15 and the main-wash zone 17, the tunnel-type washing machine 30 corresponds to the tunnel-type washing machine 10, and so identical reference numerals are used for the same parts in this respect.

In the exemplary embodiment shown, the final-treatment zone 31 is formed from a single chamber 32. However, the final-treatment zone 31 can also be formed from a plurality of successive chambers 32. Both rinsing and water removal or water removal and rinsing of the items of laundry take place in the final-treatment zone 31, with the free liquor previously having been separated from the items of laundry in the final-treatment zone 31 or as early as at the end of the main-wash zone 17. The items of laundry can be rinsed and have water removed or have water removed and be rinsed successively, at the same time and/or in an overlapping manner in the final-treatment zone 31. Water is preferably initially removed from the items of laundry in the final-treatment zone 31 by the bound liquor (main-wash liquor) originating from the main-wash zone 17 initially being at least partly, preferably largely, removed from the items of laundry. The items of laundry are then rinsed with the addition of fresh water. However, it is also feasible for the water to be continuously removed from the items of laundry in the final-treatment zone 31 by water being continuously or periodically added during the rinse process. At the end of the rinse process, the addition of preferably fresh water is stopped and water is removed from the laundry. Laundry from which water has already been removed then leaves the tunnel-type washing machine 30 via the discharging chute 23, with the result that, in contrast to the above-described exemplary embodiments, a separate water-removal process is no longer required following the tunnel-type washing machine 30 in a water-removal device which is connected downstream of the tunnel-type washing machine 30.

In the tunnel-type washing machine 30, the prewash zone 15 and the main-wash zone 17 are, as in the tunnel-type washing machine 10 of the exemplary embodiments from FIGS. 1 to 4, arranged in a common drum 12 which can be driven in rotation about an approximately horizontal axis of rotation 11, to be precise either in a circulating manner and/or so as to pivot with successive opposing partial revolutions, but also in a different, conventional way. A separate drum 33 for forming only the final-treatment zone 31 follows the drum 12 for accommodating the prewash zone 15 and the main-wash zone in the passage direction 16. In the exemplary embodiment shown, this drum 33 has the same outside diameter as that of the drum 12. The axis of rotation of the drum 32 is situated on the axis of rotation 11 of the drum 12. The drums 12 and 33 follow one another directly, with the result that the items of laundry from the main-wash drum 17 of the drum 12 can be directly transferred to the drum 33.

Both the drum 12 and the drum 33 have their own drives 34 and 35 and separate drum-mounting means. In this way, the drums 12 and 33 can be driven in rotation independently of one another. In particular, the drum 33 can be driven at a greater rotational speed than the drum 12 by its own drive 35 for the purpose of effective removal of water from the items of laundry. The type of drive of the drum 33, which serves for water removal purposes, of the final-treatment zone 31 may also differ from that of the drum 12 with the prewash zone 15 and the main-wash zone 17. It is therefore possible to treat the laundry in the tunnel-type washing machine 30 at different rotational speeds and types of drive. Above all, the drum 33 can be driven at a substantially greater rotational speed than the drum 12, as a result of which the drum 33 can realize its function as a spin-dryer.

LIST OF REFERENCE SYMBOLS

10 Tunnel-type washing machine
11 Axis of rotation
12 Drum
13 Partition wall
14 Chamber
15 Prewash zone
16 Passage direction
17 Main-wash zone
18 Spin-dryer
19 Pivot axis
20 Outer drum
21 Axis of rotation
22 Opening
23 Discharging chute
24 Rail
25 Laundry-storage means
26 Container
27 Rail
28 Water-removal press
29 Collection tank
30 Tunnel-type washing machine
31 Final-treatment zone
32 Chamber
33 Drum
34 Drive
35 Drive

What is claimed is:

1. A method for the wet-treatment of items of laundry, comprising:

a) washing the items of laundry in a washing device, wherein the items of laundry are only washed in the washing device;

b) removing at least water in at least one downstream water-removal device; and c) rinsing and removing water from the items of laundry in the at least one water-removal device, wherein the water-removal device is at least one spin-dryer (18), and wherein the washing device is a tunnel-type washing machine (10, 30).

2. The method as claimed in claim 1, wherein the items of laundry contain bound liquor from being washed and the items of laundry are transferred from the washing device to the at least one water-removal device substantially only with at least some of the bound liquor from being washed.

3. The method as claimed in claim 1, wherein the items of laundry contain bound liquor from being washed and the items of laundry are separated at least from some of the bound liquor from being washed before being rinsed.

4. The method as claimed in claim 1, wherein one batch of the items of laundry are transferred from the washing device directly to one of a plurality of the water-removal devices and one batch of the items of laundry are at least temporarily stored before being transferred to the respective water-removal device.

5. The method as claimed in claim 1, wherein the items of laundry are subjected to only a prewashing operation and a main-washing operation in the washing device.

6. The method as claimed in claim 1, wherein the items of laundry are transferred from the washing device directly to the at least one water-removal device.

7. The method as claimed in claim 1, wherein the items of laundry are at least temporarily stored before being transferred to the at least one water-removal device.

8. The method as claimed in claim 1, wherein the tunnel-type washing machine (10, 30) has only a prewash treatment zone (15) and a downstream main-wash treatment zone (17).

9. A method for the wet-treatment of items of laundry, comprising:

a) washing the items of laundry in a washing operation in successive treatment zones of a tunnel-type washing machine (30), wherein the items of laundry are only washed in the washing machine, and wherein the items of laundry contain bound liquor from the washing step;

b) rinsing the items of laundry in a rinsing operation after the washing operation, the rinsing operation comprising the steps of:

i) separating the items of laundry from at least some of the bound liquor; and then ii) rinsing and removing water from the items of laundry in at least one water-removal device, wherein the at least one water removal device is at least one spin-dryer (18).

10. The method as claimed in claim 9, wherein the items of laundry are separated at least from some of the bound liquor from one of the successive treatment zones, before rinsing, with the separation being performed in another one of the successive treatment zones which serves for rinsing and/or water-removal purposes, wherein the bound liquor is from one of the successive treatment zones preceding the another one of the successive treatment zones which serves for rinsing and/or water-removal purposes.

11. A method for the wet-treatment of items of laundry, comprising the steps of:

a) washing the items of laundry in a tunnel-type washing machine (10, 30), wherein the items of laundry are only washed in the tunnel-type washing machine (10, 30);

b) rinsing the items of laundry in at least one spin dryer (18) separate from the tunnel-type washing machine; and c) removing at least water from the items of laundry when in the at least one spin dryer (18).

12. The method as claimed in claim 11, wherein the items of laundry contain bound liquor from being washed and the items of laundry are transferred from the tunnel-type washing machine (10, 30) to the at least one spin dryer (18) substantially only with at least some of the bound liquor from being washed.

13. The method as claimed in claim 12, wherein the items of laundry are separated at least from some of the bound liquor from being washed before being rinsed.

14. The method as claimed in claim 11, wherein one batch of the items of laundry are transferred from the tunnel-type washing machine (10, 30) directly to the at least one spin dryer (18) and one batch of the items of laundry are at least temporarily stored before being transferred to the at least one spin dryer (18).

15. A method for the wet-treatment of items of laundry, consisting essentially of the steps of:

a) washing the items of laundry in a tunnel-type washing machine (10, 30), wherein the items of laundry are only washed in the tunnel-type washing machine (10, 30);

b) rinsing the items of laundry in at least one spin dryer (18) separate from the tunnel-type washing machine; and c) removing at least water from the items of laundry when in the at least one spin dryer (18).

16. The method as claimed in claim 15, wherein the items of laundry contain bound liquor from being washed and the items of laundry are transferred from the tunnel-type washing machine (10, 30) to the at least one spin dryer (18) substantially only with at least some of the bound liquor from being washed.

17. The method as claimed in claim 16, wherein the items of laundry are separated at least from some of the bound liquor from being washed before being rinsed.

18. The method as claimed in claim 15, wherein one batch of the items of laundry are transferred from the tunnel-type washing machine (10, 30) directly to the at least one spin dryer (18) and one batch of the items of laundry are at least temporarily stored before being transferred to the at least one spin dryer (18).

* * * * *